US010011979B1

(12) United States Patent
Kwong

(10) Patent No.: US 10,011,979 B1
(45) Date of Patent: Jul. 3, 2018

(54) HOUSE HAVING ALUMINUM ALLOY STRUCTURE

(71) Applicant: AluHouse Technology (GD) Company Limited, Guangdong (CN)

(72) Inventor: Hoi Fung Kwong, Guangdong (CN)

(73) Assignee: AluHouse Technology (GD) Company Limited, Guangdong (CN)

( * ) Notice: Subject to any disclaimer, the term of this patent is extended or adjusted under 35 U.S.C. 154(b) by 0 days.

(21) Appl. No.: 15/715,266

(22) Filed: Sep. 26, 2017

(30) Foreign Application Priority Data

Mar. 24, 2017 (CN) ..... 2017 1 0184811

(51) Int. Cl.
*E04B 1/08* (2006.01)
*E04C 2/08* (2006.01)
*E04B 1/348* (2006.01)

(52) U.S. Cl.
CPC ..... *E04B 1/08* (2013.01); *E04B 1/3483* (2013.01); *E04C 2/08* (2013.01)

(58) Field of Classification Search
CPC .. E04B 1/08; E04B 1/3483; E04B 2001/2484; Y10T 29/49629; B32B 2419/00; E04C 2/08
See application file for complete search history.

(56) References Cited

U.S. PATENT DOCUMENTS 5,204,149 A * 4/1993 Phenicie ..... B65D 90/026 220/1.5
6,324,796 B1 * 12/2001 Heath ..... E04B 5/026 52/177
7,596,924 B2 * 10/2009 Sakae ..... B62D 25/06 296/155
7,665,651 B2 * 2/2010 Aota ..... B23K 20/122 228/112.1
2009/0223153 A1 * 9/2009 MacGregor ..... E04B 1/3483 52/284
2016/0319534 A1 * 11/2016 Bernardo ..... E04B 1/3483

* cited by examiner

*Primary Examiner* — Andrew J Triggs
(74) *Attorney, Agent, or Firm* — Alan D. Kamrath; Kamrath IP Lawfirm, P.A.

(57) ABSTRACT

A house has an aluminum alloy structure with a mounting connection structure of aluminum wallboards, aluminum roof panels, aluminum floor panels and corner connecting materials. Connecting parts of the aluminum wallboards, the aluminum roof panels, the aluminum floor panels and the corner connecting materials are provided with convex and concave retaining grooves. The aluminum wallboards, the aluminum roof panels, the aluminum floor panels and the corner connecting materials are embedded with one another in mounting connection and then fixed by bolts or screws. The integral connection structure of various components has higher anti-bending performance, anti-torque performance, anti-impact performance and stability, reduces or avoids the use of bottom crossbeams, upright columns and ring beams, and increases the utilization space of the house. Aluminum surface eaves are designed to enhance the waterproof performance of wall surfaces of the house and also enhance the artistic performance of the house. The house having the aluminum alloy structure has the characteristics of good waterproof performance and convenience in mounting while saving a sealing material.

9 Claims, 8 Drawing Sheets

HOUSE HAVING ALUMINUM ALLOY STRUCTURE

BACKGROUND OF THE INVENTION

The present invention belongs to the field of architectural structures, and relates to a house having an aluminum alloy structure and, more particularly, to an integrated structure of a house having an aluminum alloy structure.

In architectural design, it is always desirable to provide a large-span space without a vertical structure, which can be flexibly partitioned as required, so that the indoor layout can be diversified. Traditional houses limit the freedom of space layout due to the nature of materials used. If the open space is too large, oversized beam and column sections will be caused, thereby not only affecting the indoor beauty, but also increasing the structural weight and the civil engineering investment.

An existing steel structure building drives the whole project investment to be higher because of its heavy weight, high cost of materials and increased foundation cost.

When heat-insulating and decorating materials are mounted and fixed inside the conventional house, the materials are directly connected to wallboards and roof panels using fixing members, thereby leading to damages of the wallboards and the roof panels and to formation of a connecting bridge, reducing the heat-insulating performance of the wallboards and the roof panels.

Assembled buildings are buildings promoted and developed energetically in China. In order to meet the national development requirements, those skilled in the art are committed to the development of a house having an integral aluminum alloy structure, which is suitable for assembled construction requirements of an aluminum alloy house. The components of the house can be produced in factories and then transported to the site for integral assembly.

BRIEF SUMMARY OF THE INVENTION

The present invention aims to provide a house having an aluminum alloy structure, which solves such problems of existing steel structure buildings, such as being heavy weight, having high cost of materials, having oversized beam and column sections, causing easy damages of wallboards and roof panels because of using fixing members during internal mounting, and causing reduction of the heat-insulating performance of the wallboards and the roof panels.

The technical solution of the present invention is as follows.

A house having an aluminum alloy structure comprises a plurality of individual aluminum alloy wallboards, a plurality of individual aluminum alloy floor panels, a plurality of individual aluminum alloy roof panels, a first corner connecting material, a second corner connecting material, a third corner connecting material, a fourth corner connecting material, a first aluminum alloy surface cave, a second aluminum alloy surface eave and fixing screws.

A retaining groove is arranged at the upper lateral part of a splicing base at one end of the individual aluminum alloy wallboard. A bulge is arranged above a splicing locking strip at the other end of the individual aluminum alloy wallboard. The splicing base of the individual wallboard and the splicing locking strip of another individual wallboard are embedded and connected with each other, and the splicing locking strip is pressed on the splicing base and connected therewith by a fixing screw. Meanwhile, the bulge and the retaining groove are connected in a buckling manner.

An upward retaining groove is arranged at the lower lateral part of a splicing base at one end of the individual aluminum alloy floor panel. A downward retaining groove is arranged below a splicing locking strip at the other end of the individual aluminum alloy floor panel. The splicing base of the individual floor panel and the splicing locking strip of another individual floor panel are embedded and connected with each other, and the splicing locking strip is pressed on the splicing base and connected therewith by a fixing screw. Meanwhile, the upward retaining groove and the downward retaining groove are connected with each other in a clasping manner.

A propping portion is arranged at the upper lateral part of a splicing base at one end of the individual aluminum alloy roof panel. A retaining groove is arranged at the lower lateral part of the splicing base. A bulge is arranged at the top of a body of a splicing locking strip at the other end of the individual aluminum alloy roof panel. A clasp is arranged above the splicing locking strip. The splicing base of the individual floor panel and the splicing locking strip of another individual floor panel are embedded and connected with each other, and the splicing locking strip is pressed on the splicing base and connected therewith by a fixing screw. The bulge and the retaining groove at this moment are connected in a buckling manner. Meanwhile, the clasp and the propping portion are connected with each other in a clasping manner.

The first corner connecting material is in an acute-angle shape. A retaining groove is arranged at the upper lateral part of a transverse splicing base at the right end of the first corner connecting material. A bulge is arranged at the lower lateral part of a longitudinal splicing base at the lower end of the first corner connecting material, and a connecting groove is arranged at the left end of the first corner connecting material. The transverse splicing base of the first corner connecting material and the splicing locking strip of the individual roof panel are embedded and connected with each other. The splicing locking strip of the roof panel is pressed on the transverse splicing base and connected therewith by a fixing screw. Meanwhile, the retaining groove and the clasp of the roof panel are connected with each other in a clasping manner. The longitudinal splicing base of the first corner connecting material and the splicing locking strip of the individual wallboard are embedded and connected with each other, and the splicing locking strip of the wallboard is pressed on the longitudinal splicing base and fixed therewith by a fixing screw. Meanwhile, the bulge of the longitudinal splicing base and the bulge of the wallboard are connected in a buckling manner.

The second corner connecting material is in an obtuse-angle shape. A bulge is arranged at the top of a body of a splicing locking strip at the left end of the second corner connecting material. A clasp is arranged above the splicing locking strip. A retaining groove is arranged at the lower lateral part of a splicing base at the lower end of the second corner connecting material, and a connecting groove is arranged at the right end of the second corner connecting material. The splicing locking strip of the second corner connecting material and the splicing base of the individual roof panel are embedded and connected with each other, and the splicing locking strip is pressed on the splicing base of the roof panel and connected therewith by a fixing screw. The bulge and the retaining groove of the roof panel at this moment are connected in a buckling manner. Meanwhile, the clasp and the propping portion of the roof panel are connected with each other in a clasping manner.

The third corner connecting material is in a right-angle shape. A transverse splicing locking strip is arranged at the right end of the third corner connecting material, and a longitudinal splicing locking strip and a retaining groove are arranged at the upper left end of the third corner connecting material. The transverse splicing locking strip and the splicing base of the individual floor panel are embedded and connected with each other, and the transverse splicing locking strip is pressed on the splicing base of the floor panel and connected therewith by a fixing screw. The longitudinal splicing locking strip and the splicing base of the individual wallboard are embedded and connected with each other, and the longitudinal splicing locking strip is pressed on the splicing base of the wallboard and connected therewith by a fixing screw. Meanwhile, the retaining groove and the retaining groove of the individual wallboard are connected with each other in a clasping manner.

The fourth corner connecting material is in a right-angle shape. A splicing base and a transverse retaining groove are arranged at the left end of the fourth corner connecting material, and a longitudinal splicing locking strip and a longitudinal retaining groove are arranged at the upper right end of the fourth corner connecting material. The splicing base and the splicing locking strip of the individual floor panel are embedded and connected with each other. The splicing locking strip is pressed on the splicing base of the floor panel and connected therewith by a fixing screw. Meanwhile, the transverse retaining groove and the downward retaining groove of the individual floor panel are connected with each other in a clasping manner. The longitudinal splicing locking strip and the splicing base of the individual wallboard are embedded and connected with each other, and the longitudinal splicing locking strip is pressed on the splicing base of the wallboard and connected therewith by a fixing screw. Meanwhile, the longitudinal retaining groove and the retaining groove of the individual wallboard are connected with each other in a clasping manner.

An upper connecting arm and a lower connecting arm are arranged at one end of the first aluminum alloy surface eave, and the end of the surface eave between the upper connecting arm and the lower connecting arm is provided with a clasp. When the first aluminum alloy surface eave and the first corner connecting material are connected, the clasp of the surface cave and the connecting groove of the first corner connecting material are connected with each other in a clasping manner.

An upper connecting arm and a lower connecting arm are arranged at one end of the second aluminum alloy surface eave, and the end of the surface cave between the upper connecting arm and the lower connecting arm is provided with a clasp. When the second aluminum alloy surface eave and the second corner connecting material are connected, the clasp of the surface eave and the connecting groove of the second corner connecting material are connected with each other in a clasping manner.

The individual aluminum alloy wallboard is provided with a C-shaped mounting notch, which is convenient for internal mounting.

The bottom of the individual aluminum alloy roof panel is provided with a C-shaped mounting notch, which is convenient for internal mounting.

Oppositely slant support ribs are arranged inside the individual aluminum alloy wallboard, oppositely slant support ribs are arranged inside the individual aluminum alloy floor panel, and oppositely slant support ribs are arranged inside the individual aluminum alloy roof panel.

A screw-burying groove is arranged in the middle of the third corner connecting material.

A screw-burying groove is arranged in the middle of the fourth corner connecting material.

A C-shaped mounting notch is arranged at the bottom of the first aluminum alloy surface eave.

A dripping rim is arranged at the other end of a mounting portion of the first aluminum alloy surface eave.

A dripping rim is arranged at the other end of a mounting portion of the second aluminum alloy surface eave.

A house having an aluminum alloy structure of the present invention comprises a roof, wall surfaces and a ground connecting structure system, in which a mounting connection structure of aluminum wallboards, aluminum roof panels, aluminum floor panels and corner connecting materials is provided. The connecting parts of the aluminum wallboards, the aluminum roof panels, the aluminum floor panels and the corner connecting materials are provided with convex or concave retaining grooves. The aluminum wallboards, the aluminum roof panels, the aluminum floor panels and the corner connecting materials are embedded with one another in mounting connection and then fixed by bolts or screws, and are thus connected more firmly and safely.

The integral connection structure of the aluminum wallboards, aluminum alloy panels, aluminum floor panels and corner connecting materials has higher anti-bending performance, anti-torque performance, anti-impact performance and stability, reduces or avoids the use of bottom crossbeams, upright columns and ring beams, and increases the utilization space of the house. The aluminum surface eaves are designed to enhance the waterproof performance of wall surfaces of the house and also enhance the artistic performance of the house. The aluminum wallboards, the roof panels, the floor panels and the corner connecting materials have specific connecting structures and good waterproof performance, and no waterproof sealing material needs to be used at the connecting parts.

The mounting connection structure of the wallboards, the roof panels and the corner connection materials made of aluminum alloy sections in the present invention are mainly applied to the wall surfaces, the roof and the ground of the aluminum alloy house. The wallboards, the roof panels, the floor panels and the corner connecting materials made of aluminum alloy sections are designed into a combined form of tight splicing and fixing with buckling notches and bolts. The aluminum alloy house of the present invention has the characteristics of good waterproof performance and convenience in mounting while saving a sealing material. The C-shaped groove designed on the aluminum surface eave of the roof can be used for the placement of an illuminating or decorating lamp strip, or may be provided with a decorating cover. The dripping eave arranged on the aluminum surface eave can prevent rainwater from flowing to the C-shaped groove and to the wall surfaces.

The house having the aluminum alloy structure of the present invention has the following advantages.

1. The wallboards, the roof panels and the floor panels have specific structure designs. Because various components have unique cross-section and connection designs, the integral structure has higher anti-bending performance, anti-torque performance and anti-impact performance, and the house having the aluminum alloy structure can withstand high wind power, and is unlikely to deform and is integrally stable. Compared to conventional designs, the use of bottom crossbeams, upright columns and ring beams is reduced or avoided.

When heat-insulating and decorating materials are mounted and fixed inside the conventional house, the materials are directly connected to wallboards and roof panels using fixing members, thereby leading damages of the wallboards and the roof panels and formation of a connecting bridge, and reducing the heat-insulating performance of the wallboards and the roof panels. The designed C-shaped mounting notch effectively avoids the damages of the wallboards and the roof panels in case of fixing during internal mounting. Heat-insulation pads are additionally arranged on the contact surfaces between the connection fixing members and the wallboards as well as the roof panels to form broken bridges. Therefore, the heat-insulation performance of the wallboards and the roof panels is improved.

2. The rainwater-proof performance is good. Because the surface of the aluminum alloy section is very smooth, and assembled parts are formed by machining in factories, the flatness and tightness at splicing parts can be ensured. Connection and locking between the wallboards, between the roof panels, between the wallboard and the corner connecting material, and between the roof panel and the corner connecting material are realized by screws or bolts, such that all the boards are seamlessly connected, thereby preventing the aluminum alloy house from getting humid inside due to leakage of rainwater through excessively large joints.

3. The mounting is convenient. The aluminum wallboards, roof panels and corner connecting materials made of aluminum alloy sections can be connected easily. Therefore, the problems of large construction difficulty and difficulty to ensure the quality, for example, caused by welding connection, are avoided.

4. Modular production is realized. It is possible to form different forms of mounting modules flexibly according to the size of the aluminum alloy house and the arrangement requirements of doors and windows. The modules can be transported to a construction site for assembled construction after being machined and pre-assembled in factories.

5. Integral hoisting is possible. According to the present invention, an aluminum alloy gantry frame and a crossbeam structure are additionally arranged, and a screw rod hoisting mechanism is designed on the gantry frame. Therefore, hoisting from the top of the house is facilitated. No dedicated hoisting device for hoisting from the bottom is needed, and the requirements of the aluminum alloy house for stable and safe integral hoisting are satisfied without affecting the integral structure stress of the house.

6. The use cost is low. The surfaces of the aluminum wallboards, roof panels, floor panels and the corner connecting materials made of aluminum alloy sections are subjected to anodic oxidation treatment, such that a hard protecting layer is generated on the whole house surface to improve the corrosion resistance, enhance the wear resistance and hardness, protect the metal surface and greatly reduce the house maintenance cost in the future.

7. The aluminum alloy house structure is completely made of aluminum alloy materials, and can thus be recycled and re-smelted after being disassembled and scraped later. The recovery value can reach 80% or more of the cost of raw materials.

8. The production and mounting technologies of the wallboards, roof panels, floor panels and corner connecting materials made of aluminum alloy sections are energy-saving and environment-friendly. All of the wallboards, roof panels and corner connecting materials are machined in factories, and are then transported to a construction site for use after being correctly spliced in advance, without performing secondary clipping, cutting or re-drilling at the site and avoiding corresponding scraps and cutting noise. No waste resides in the site, and the construction environment is safe, clean and tidy.

9. Low carbon and emission reduction are achieved. The raw materials for building templates made of aluminum alloy sections are reproducible aluminum alloy materials, and can meet the requirements on energy saving, environment friendliness, low carbon and emission reduction of construction projects in China.

REFERENCE NUMERALS

Figure 1:
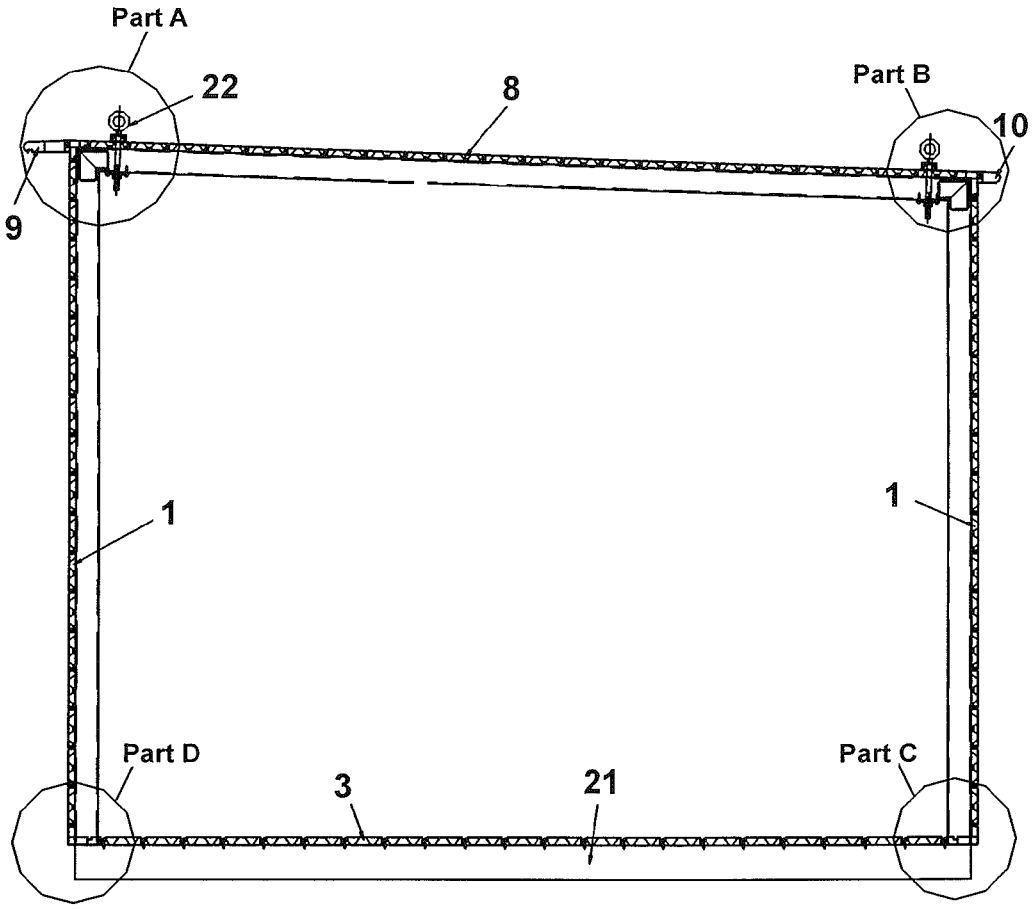
FIG. 1 is a schematic diagram of an integral connection structure of a house having an aluminum alloy structure according to the present invention.

1—aluminum alloy wallboard, 2—fixing screw, 3—aluminum alloy floor panel, 4—corner connecting material, 5—corner connecting material, 6—corner connecting material, 7—corner connecting material, 8—aluminum alloy, roof panel, 9—first aluminum alloy surface eave, 10—second aluminum alloy surface eave;

11—splicing base of wallboard, 12—splicing locking strip of wallboard, 13—bulge of wallboard, 14—retaining groove of wallboard, 15—support rib, 16—C-shaped mounting notch of wallboard;

21—bottom crossbeam, 22—hoisting screw rod, 23—waterproof aluminum groove at hoisting point, 24—gantry frame, 25—nut;

31—splicing base of floor panel, 32—upward retaining groove of floor panel, 33—splicing locking strip of floor panel, 34—downward retaining groove of floor panel, 35—support rib;

41—transverse splicing locking strip of third corner connecting material, 42—longitudinal splicing locking strip of third corner connecting material, 43—retaining groove of third corner connecting material, 44—screw-burying groove of third corner connecting material;

51—splicing base of fourth corner connecting material, 52—longitudinal splicing locking strip of fourth corner connecting material, 53—transverse retaining groove of fourth corner connecting material, 54—longitudinal retaining groove of fourth corner connecting material, 55—screw-burying groove of fourth corner connecting material;

61—transverse splicing base of first corner connecting material, 62—retaining groove of first corner connecting material, 63—longitudinal splicing base of first corner connecting material, 64—bulge of first corner connecting material, 65—connecting groove of first corner connecting material;

71—splicing base of second corner connecting material, 72—retaining groove of second corner connecting material, 73—splicing locking strip of second corner connecting material, 74—bulge of second corner connecting material, 75—clasp of second corner connecting material, 76—connecting groove of second corner connecting material;

81—splicing base of roof panel, 82—splicing locking strip of roof panel, 83—bulge of roof panel, 84—retaining groove of roof panel, 85—propping portion of roof panel, 86—clasp of roof panel, 87—C-shaped mounting notch of roof panel, 88—support rib;

91—upper connecting arm of first surface eave, 92—lower connecting arm of first surface eave, 93—clasp of first surface eave, 94—C-shaped mounting notch of first surface eave, 95—dripping rim of first surface eave;

101—upper connecting arm of second surface eave, 102—lower connecting arm of second surface eave, 103—clasp of second surface eave, 105—dripping rim of second surface eave.

DETAILED DESCRIPTION OF THE INVENTION

The present invention will be described in detail as below in conjunction with the drawing and embodiments.

Referring to FIGS. 1-5, the present invention provides a house having an aluminum alloy structure. The house having the aluminum alloy structure is mainly composed of a plurality of individual aluminum alloy wallboards 1, a plurality of individual aluminum alloy floor panels 3, a plurality of individual aluminum alloy roof panels 8, a first corner connecting material 4, a second corner connecting material 5, a third corner connecting material 6, a fourth corner connecting material 7, a first aluminum alloy surface eave 9, a second aluminum alloy surface eave 10 and fixing screws 2.

Figure 2:
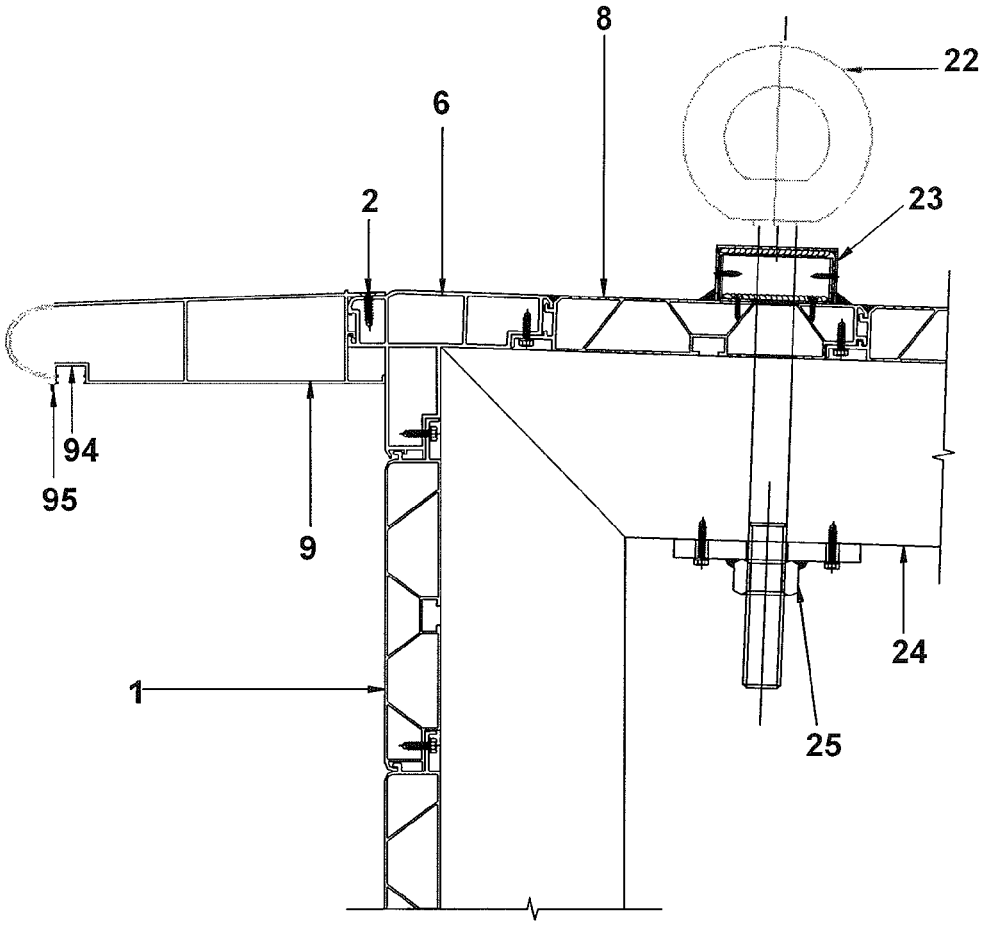
FIG. 2 is a schematic diagram of part A in FIG. 1.
Figure 3:
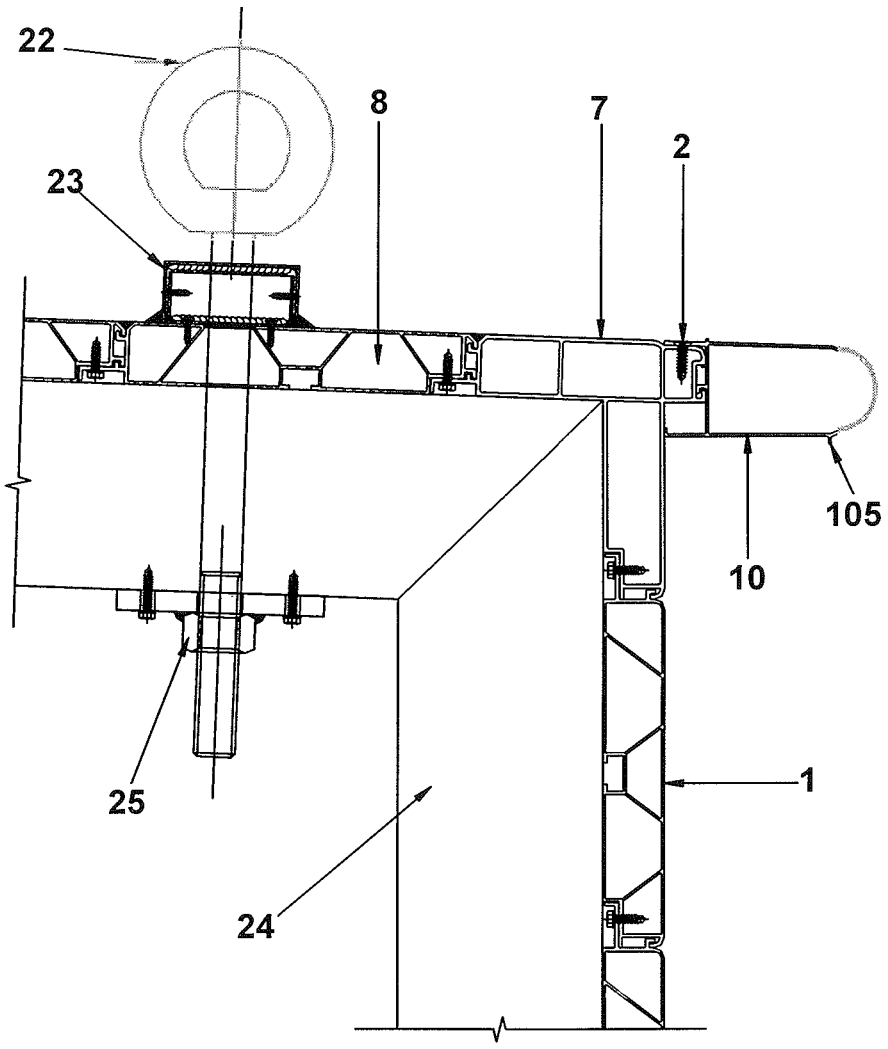
FIG. 3 is a schematic diagram of part B in FIG. 1.
Figure 6:
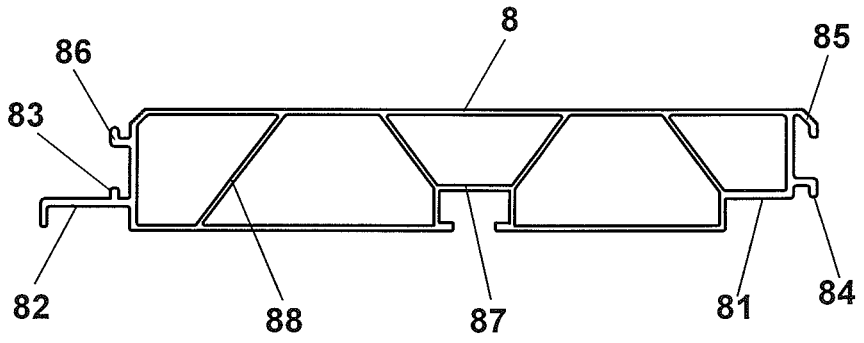
FIG. 6 is a sectional view of an aluminum alloy roof panel.

Referring to FIG. 6 and in combination with FIGS. 1-3, a propping portion 85 is arranged at the upper lateral part of a splicing base 81 at one end of the individual aluminum alloy roof panel 8, and a retaining groove 84 is arranged at the lower lateral part of the splicing base 81. A bulge 83 is arranged at the top of a body of a splicing locking strip 82 at the other end of the individual aluminum alloy roof panel 8, and a clasp 86 is arranged above the splicing locking strip 82. The splicing base 81 of the individual floor panel and the splicing locking strip 82 of another individual floor panel are embedded and connected with each other. That is, the splicing locking strip 82 is pressed on the splicing base 81 and connected therewith by a fixing screw 2, and the bulge 83 and the retaining groove 84 at this moment are connected in a buckling manner. Meanwhile, the clasp 86 and the propping portion 85 are connected with each other in a clasping manner.

Figure 7:
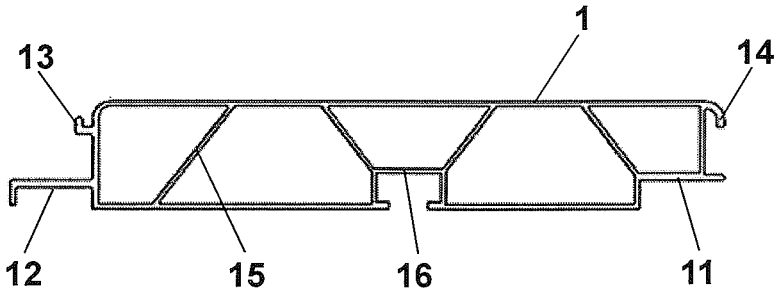
FIG. 7 is a sectional view of an aluminum alloy wallboard.

Referring to FIG. 7 and in combination with FIGS. 1-5, a retaining groove 14 is arranged at the upper lateral part of a splicing base 11 at one end of the individual aluminum alloy wallboard 1. A bulge 13 is arranged above a splicing locking strip 12 at the other end of the individual aluminum alloy wallboard 1, and the splicing base 11 of the individual wallboard and the splicing locking strip 12 of another single individual wallboard are embedded and connected with each other. That is, the splicing locking strip 12 is pressed on the splicing base 11 and connected therewith by a fixing screw 2. Meanwhile, the bulge 13 and the retaining groove 14 are connected in a buckling manner.

Figure 4:
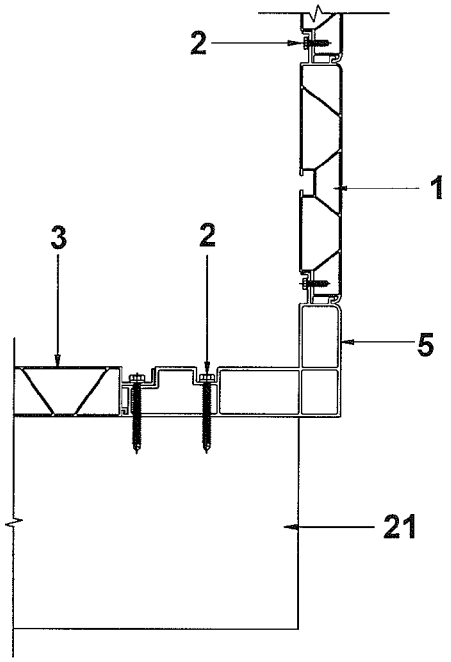
FIG. 4 is a schematic diagram of part C in FIG. 1.
Figure 5:
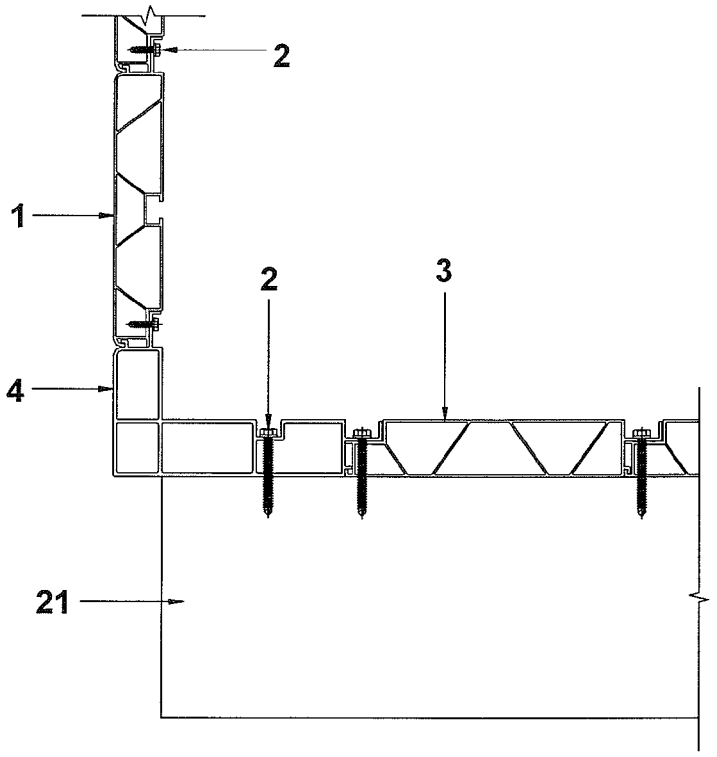
FIG. 5 is a local schematic diagram of part D in FIG. 1.
Figure 8:
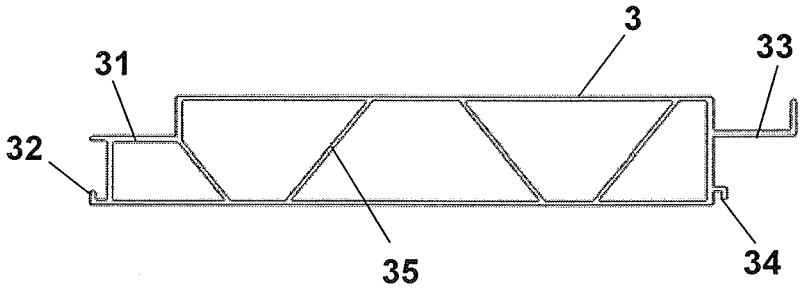
FIG. 8 is a sectional view of an aluminum alloy floor panel.

Referring to FIG. 8 and in combination with FIGS. 1, 4 and 5, an upward retaining groove 32 is arranged at the lower lateral part of a splicing base 31 at one end of the individual aluminum alloy floor panel 3. A downward retaining groove 34 is arranged below a splicing locking strip 33 at the other end of the individual aluminum alloy floor panel 3, and the splicing base 31 of the individual floor panel and the splicing locking strip 33 of another individual floor panel are embedded and connected with each other. That is, the splicing locking strip 33 is pressed on the splicing base 31 and connected therewith by a fixing screw 2. Meanwhile, the upward retaining groove 32 and the downward retaining groove 34 are connected in a clasping manner.

Figure 9:
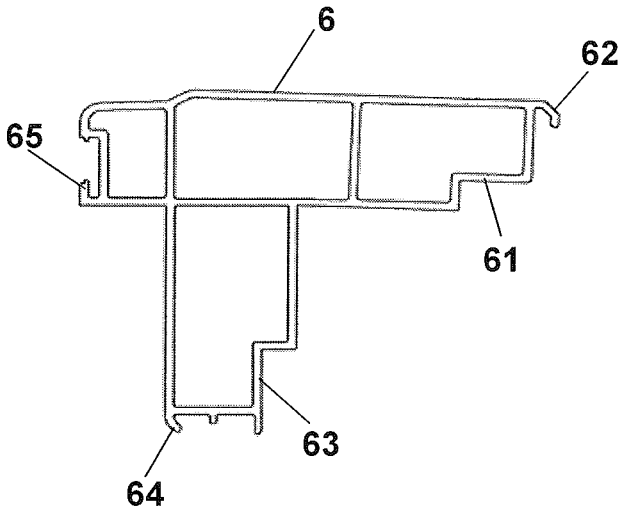
FIG. 9 is a sectional view of a first corner connecting material.

Referring to FIG. 9 and in combination with FIGS. 1 and 2, the first corner connecting material 6 is in an acute-angle shape. A retaining groove 62 is arranged at the upper lateral part of a transverse splicing base 61 at the right end of the first corner connecting material 6. A bulge 64 is arranged at the lower lateral part of a longitudinal splicing base 63 at the lower end of the first corner connecting material 6, and a connecting groove 65 is arranged at the left end of the first corner connecting material 6. The transverse splicing base 61 of the first corner connecting material and the splicing locking strip 82 of the individual roof panel are embedded and connected with each other. That is, the splicing locking strip 82 of the roof panel is pressed on the transverse splicing base 61 and connected therewith by a fixing screw 2. Meanwhile, the retaining groove 62 and the clasp 86 of the roof panel are connected with each other in a clasping manner. The longitudinal splicing base 63 of the first corner connecting material and the splicing locking strip 12 of the individual wallboard are embedded and connected with each other, and the splicing locking strip 12 of the wallboard is pressed on the longitudinal splicing base 63 and connected therewith by a fixing screw 2. Meanwhile, the bulge 64 and the bulge 13 of the wallboard are connected in a buckling manner. Therefore, a stable connection state is formed.

Figure 10:
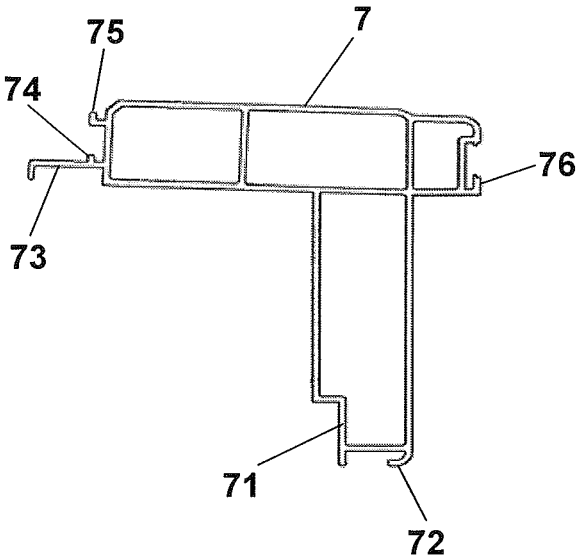
FIG. 10 is a sectional view of a second corner connecting material.

Referring to FIG. 10 and in combination with FIGS. 1 and 3, the second corner connecting material 7 is in an obtuse-angle shape. A bulge 74 is arranged at the top of a body of a splicing locking strip 73 at the left end of the second corner connecting material 7, and a clasp 75 is arranged above the splicing locking strip 73. A retaining groove 72 is arranged at the lower lateral part of a splicing base 71 at the lower end of the second corner connecting material 7, and a connecting groove 76 is arranged at the right end of the second corner connecting material 7. The splicing locking strip 73 of the second corner connecting material and the splicing base 81 of the individual roof panel are embedded and connected with each other. That is, the splicing locking strip 73 is pressed on the splicing base 81 of the roof panel and connected therewith by a fixing screw 2. The bulge 74 and the retaining groove 84 of the roof panel at this moment are connected in a buckling manner. Meanwhile, the clasp 75 and the propping portion 85 of the roof panel are connected with each other in a clasping manner. Therefore, a stable connection state is formed.

Figure 11:
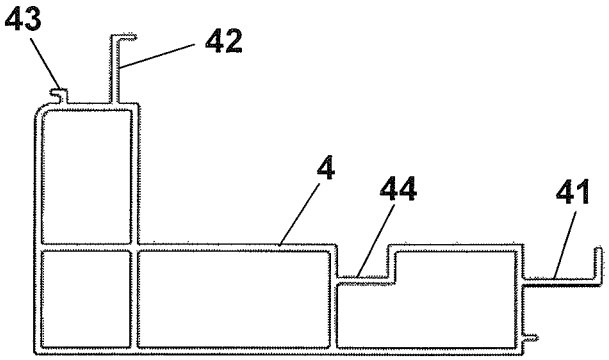
FIG. 11 is a sectional view of a third corner connecting material.

Referring to FIG. 11 and in combination with FIGS. 1 and 5, the third corner connecting material 4 is in a right-angle shape. A transverse splicing locking strip 41 is arranged at the right end of the third corner connecting material 4, and a longitudinal splicing locking strip 42 and a retaining groove 43 are arranged at the upper left end of the third corner connecting material 4. The transverse splicing locking strip 41 and the splicing base 31 of the individual floor panel are embedded and connected with each other. That is, the transverse splicing locking strip 41 is pressed on the splicing base 31 of the floor panel and connected therewith by a fixing screw 2. The longitudinal splicing locking strip 42 and the splicing base 11 of the individual wallboard are embedded and connected with each other, and the longitudinal splicing locking strip 42 is pressed on the splicing base 11 of the wallboard and connected therewith by a fixing screw 2. Meanwhile, the retaining groove 43 and the retaining groove 14 of the individual wallboard are connected with each other in a clasping manner. Therefore, a stable connection state is formed.

Figure 12:
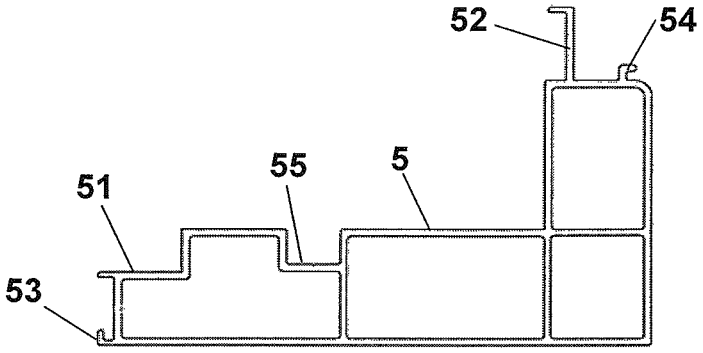
FIG. 12 is a sectional view of a fourth corner connecting material.

Referring to FIG. 12 and in combination with FIGS. 1 and 4, the fourth corner connecting material 5 is in a right-angle shape. A splicing base 51 and a transverse retaining groove 53 are arranged at the left end of the fourth corner connecting material 5, and a longitudinal splicing locking strip 52 and a longitudinal retaining groove 54 are arranged at the upper right end of the fourth corner connecting material 5. The splicing base 51 and the splicing locking strip 33 of the individual floor panel are embedded and connected with each other. That is, the splicing locking strip 33 is pressed on the splicing base 51 of the floor panel and connected therewith by a fixing screw 2. Meanwhile, the transverse retaining groove 53 and the downward retaining groove 34 of the individual floor panel are connected with each other in a clasping manner. The longitudinal splicing locking strip 52 and the splicing base 11 of the individual wallboard are embedded and connected with each other, and the longitudinal splicing locking strip 52 is pressed on the splicing base 11 of the wallboard and connected by a the fixing screw 2. Meanwhile, the longitudinal retaining groove 54 and the retaining groove 14 of the individual wallboard are connected with each other in a clasping manner. Therefore, a stable connection state is formed.

As shown in FIG. 11, a screw-burying groove 44 is arranged in the middle of the third corner connecting material 4 and used for fixing and concealing the screw 2 or the bolt. As shown in FIG. 12, a screw-burying groove 55 is also arranged in the middle of the fourth corner connecting material 5 and used for firmly fixing and concealing the screw 2 or the bolt.

Figure 13:
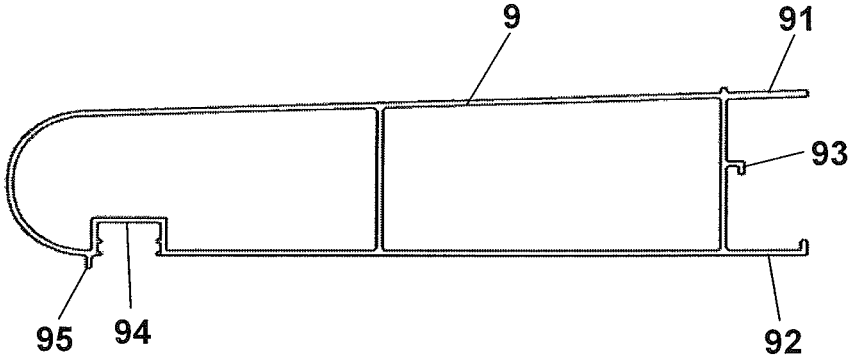
FIG. 13 is a sectional view of a first aluminum surface eave.

Referring to FIG. 13 and in combination with FIGS. 1 and 2, an upper connecting arm 91 and a lower connecting arm 92 are arranged at one end of the first aluminum alloy surface eave 9, and the end of the surface eave between the upper connecting arm 91 and the lower connecting arm 92 is provided with a clasp 93. When the first aluminum alloy surface eave 9 and the first corner connecting material 6 are connected, the clasp 93 of the surface eave and the connecting groove 65 of the first corner connecting material are connected with each other in a clasping manner.

Figure 14:
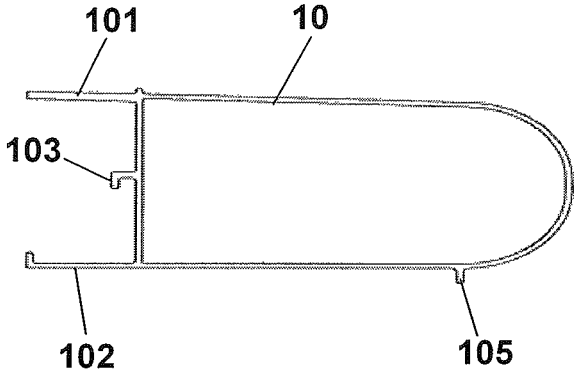
FIG. 14 is a sectional view of a second aluminum surface eave.

Referring to FIG. 14 and in combination with FIGS. 1 and 3, an upper connecting arm 101 and a lower connecting arm 102 are arranged at one end of the second aluminum alloy surface eave 10, and the end of the surface eave between the upper connecting arm 101 and the lower connecting arm 102 is provided with a clasp 103. When the second aluminum alloy surface eave 10 and the second corner connecting material 7 are connected, the clasp 103 of the surface eave and the connecting groove 76 of the second corner connecting material are connected with each other in a clasping manner.

As shown in FIGS. 13, 1 and 2, a C-shaped mounting notch 94 is arranged at the bottom of the first aluminum alloy surface eave 9, and a dripping rim 95 is arranged at the other end of a mounting portion of the first aluminum alloy surface eave 9. A C-shaped groove designed on the aluminum surface eave of the roof can be used for the placement of an illuminating or decorating lamp strip, or may be provided with a decorating cover.

As shown in FIGS. 14, 1 and 3, a dripping rim 105 is arranged at the other end of a mounting portion of the second aluminum alloy surface eave 10. The dripping eave arranged on the aluminum surface eave can prevent rainwater from flowing to the wall surfaces. The aluminum surface eave is designed to enhance the waterproof performance of wall surfaces of the house and also enhance the artistic performance of the house.

As shown in FIGS. 6 and 7, a C-shaped mounting notch 87 convenient for internal mounting is arranged at the bottom of the individual aluminum alloy roof panel 8. The individual aluminum alloy wallboard 1 is also provided with a C-shaped mounting notch 16 convenient for internal mounting. The designed C-shaped mounting notches can effectively avoid damage of the wallboards and the roof panels in case of fixing during internal mounting. Heat-insulation pads are additionally arranged on the contact surfaces between the connection fixing members and the wallboards as well as the roof panels to form broken bridges. Therefore, the heat-insulation performance of the wallboards and the roof panels are improved.

Also as shown in FIGS. 6, 7 and 8, a plurality of oppositely slant support ribs 88 is arranged inside the individual aluminum alloy roof panel 8. A plurality of oppositely slant support ribs 15 is arranged inside the individual aluminum alloy wallboard 1. A plurality of oppositely slant support ribs 35 is also arranged inside the individual aluminum alloy floor panel 3. These ribs can improve the anti-bending performance, the anti-torque performance, the anti-impact performance and the flatness of the aluminum alloy roof panels, wallboards and floor panels per se, reduce the investment amount of extra support members and fastening members, and simplify the procedures of assembling the roof panels, the wallboards and the floor panels on the site.

According to the house having the aluminum alloy structure of the present invention, as shown in FIGS. 1-5, in order to facilitate hoisting, an aluminum alloy gantry frame and a crossbeam structure are additionally arranged, and a bottom crossbeam 21 is arranged under the individual aluminum alloy floor panel 3 (see FIGS. 1, 4 and 5). A screw rod hoisting mechanism (see FIG. 3) is designed on the gantry frame 24. A hoisting screw rod 22 passes through a waterproof aluminum groove 23 at a hoisting point and is vertically arranged on the gantry frame 24. The head of the hoisting screw rod 22 and the waterproof aluminum groove 23 at the hoisting point are located on the individual aluminum alloy roof panel 8. A nut 25 is mounted at the lower part of the hoisting screw rod 22 for fastening the hoisting screw rod. By such an arrangement, hoisting from the top of the house is facilitated, no dedicated hoisting device for hoisting from the bottom is needed, and the requirements of the aluminum alloy house for stable and safe integral hoisting are satisfied without affecting the integral structure stress of the house.

From the above, the house having the aluminum alloy structure of the present invention is mainly applied to the wall surface, the roof and the ground of the aluminum alloy house. The wallboards, the roof panels, the floor panels and the corner connecting materials made of aluminum alloy sections are designed into a combined form of tight splicing and fixing with notches and bolts. The aluminum alloy house of the present invention has the characteristics of good waterproof performance and convenience in mounting while saving a sealing material.

Of course, it will be understood by those skilled in the art that the foregoing embodiments are intended to be illustrative of the invention and are not intended to limit the present invention. Variations, modifications and the like of the above-described embodiments shall fall within the scope of the appended claims as long as they are within the spirit of the present invention.

The invention claimed is:

1. A house having an aluminum alloy structure, comprising: a plurality of individual aluminum alloy wallboards, a plurality of individual aluminum alloy floor panels, a plurality of individual aluminum alloy roof panels, a first corner connecting material, a second corner connecting material, a third corner connecting material, a fourth corner connecting material, a first aluminum alloy surface eave, and a second aluminum alloy surface eave, wherein:

a wallboard retaining groove is arranged at an upper lateral part of a wallboard splicing base at one end of each individual aluminum alloy wallboard, a wallboard bulge is arranged above a wallboard splicing locking strip at another end of each individual aluminum alloy wallboard, with the wallboard splicing base of one of the plurality of individual aluminum alloy wallboards and the wallboard splicing locking strip of one of another plurality of the individual wallboards are embedded and connected with each other, the wallboard splicing locking strip is pressed on the wallboard splicing base and connected therewith by a fixing screw, and the wallboard bulge and the wallboard retaining groove are connected in a buckling manner;

an upward retaining groove is arranged at a lower lateral part of a floor splicing base at one end of each individual aluminum alloy floor panel, a downward retaining groove is arranged below a floor splicing locking strip at another end of each individual aluminum alloy floor panel, the roof splicing base of one of the plurality of individual aluminum alloy floor panels and the floor splicing locking strip of another of the plurality of individual aluminum alloy floor panels are embedded and connected with each other, the floor splicing locking strip is pressed on the floor splicing base and connected therewith by a fixing screw, and the upward retaining groove and the downward retaining groove are connected with each other in a clasping manner;

a propping portion is arranged at an upper lateral part of a roof splicing base at one end of each individual aluminum alloy roof panel, a roof retaining groove is arranged at a lower lateral part of the roof splicing base, a roof bulge is arranged at a top of a body of a roof splicing locking strip at another end of each individual aluminum alloy roof panel, a roof clasp is arranged above the roof splicing locking strip, the roof splicing base of one of the plurality of individual aluminum alloy floor panels and the roof splicing locking strip of another of the plurality of individual aluminum alloy floor panels are embedded and connected with each other, the roof splicing locking strip is pressed on the roof splicing base and connected therewith by a fixing screw, the roof bulge and the roof retaining groove are connected in a buckling manner, and the roof clasp and the propping portion are connected with each other in a clasping manner;

the first corner connecting material is in an acute-angle shape, a first corner retaining groove is arranged at an upper lateral part of a transverse splicing base at a right end of the first corner connecting material, a first corner bulge is arranged at a lower lateral part of a longitudinal splicing base at a lower end of the first corner connecting material, and a connecting groove is arranged at a left end of the first corner connecting material; the transverse splicing base of the first corner connecting material and the roof splicing locking strip are embedded and connected with each other, the roof splicing locking strip is pressed on the transverse splicing base and is connected therewith by a fixing screw, and the first corner retaining groove and the roof clasp are connected with each other in a clasping manner; the longitudinal splicing base of the first corner connecting material and the wallboard splicing locking strip are embedded and connected with each other, the wallboard splicing locking strip is pressed on the longitudinal splicing base and is connected therewith by a fixing screw, and the first corner bulge and the wallboard bulge are connected in a buckling manner;

the second corner connecting material is in an obtuse-angle shape, a second corner bulge is arranged at a top of a body of a second corner splicing locking strip at a left end of the second corner connecting material, a second corner clasp is arranged above the second corner splicing locking strip, a second corner retaining groove is arranged at a lower lateral part of a second corner splicing base at a lower end of the second corner connecting material, and a second corner connecting groove is arranged at a right end of the second corner connecting material; the second corner splicing locking strip of the second corner connecting material and the roof splicing base are embedded and connected with each other, the second corner splicing locking strip is pressed on the roof splicing base and is connected therewith by a fixing screw, the roof bulge and the roof retaining groove are connected in a buckling manner, and the second corner clasp and the propping portion are connected with each other in a clasping manner;

the third corner connecting material is in a right-angle shape, a transverse splicing locking strip is arranged at a right end of the third corner connecting material, and a third longitudinal splicing locking strip and a third corner retaining groove are arranged at an upper left end of the third corner connecting material; the transverse splicing locking strip and the floor splicing base are embedded and connected with each other, and the transverse splicing locking strip is pressed on the floor splicing base and connected therewith by a fixing screw; the third corner longitudinal splicing locking strip and the wallboard splicing base are embedded and connected with each other, the longitudinal splicing locking strip is pressed on the wallboard splicing base and connected therewith by a fixing screw, and the third corner retaining groove and the wallboard retaining groove are connected with each other in a clasping manner;

the fourth corner connecting material is in a right-angle shape, a fourth corner splicing base and a fourth corner transverse retaining groove are arranged at a left end of the fourth corner connecting material, and a longitudinal splicing locking strip and a fourth corner longitudinal retaining groove are arranged at an upper right end of the fourth corner connecting material; the fourth corner splicing base and the floor splicing locking strip are embedded and connected with each other; the fourth corner splicing locking strip is pressed on the floor splicing base and connected therewith by a fixing screw, and the fourth corner transverse retaining groove and the downward retaining groove are connected with each other in a clasping manner; the fourth corner longitudinal splicing locking strip and the wallboard splicing base are embedded and connected with each other, the fourth corner longitudinal splicing locking strip is pressed on the wallboard splicing base and connected therewith by a fixing screw, and the longitudinal retaining groove and the wallboard retaining groove are connected with each other in a clasping manner;

a first upper connecting arm and a first lower connecting arm are arranged at one end of the first aluminum alloy surface eave, and an end of the first aluminum alloy surface eave between the first upper connecting arm and the first lower connecting arm is provided with a clasp; when the first aluminum alloy surface eave and the first corner connecting material are connected, the clasp of the first aluminum alloy surface eave and the connecting groove of the first corner connecting material are connected with each other in a clasping manner; and a second upper connecting arm and a second lower connecting arm are arranged at one end of the second aluminum alloy surface eave, and an end of the second aluminum alloy surface eave between the second upper connecting arm and the second lower connecting arm is provided with a clasp; when the second aluminum alloy surface eave and the second corner connecting material are connected, the clasp of the second aluminum alloy surface eave and the connecting groove of the second corner connecting material are connected with each other in a clasping manner.

2. The house having the aluminum alloy structure according to claim 1, wherein each individual aluminum alloy wallboard is provided with a C-shaped mounting notch for internal mounting.

3. The house having the aluminum alloy structure according to claim 1, wherein a bottom of each individual aluminum alloy roof panel is provided with a C-shaped mounting notch for internal mounting.

4. The house having the aluminum alloy structure according to claim 1, wherein oppositely slant support ribs are arranged inside each individual aluminum alloy wallboard; oppositely slant support ribs are arranged inside each individual aluminum alloy floor panel; and oppositely slant support ribs are arranged inside each individual aluminum alloy roof panel.

5. The house having the aluminum alloy structure according to claim 1, wherein a screw-burying groove is arranged in a middle of the third corner connecting material.

6. The house having the aluminum alloy structure according to claim 1, wherein a screw-burying groove is arranged in a middle of the fourth corner connecting material.

7. The house having the aluminum alloy structure according to claim 1, wherein a C-shaped mounting notch is arranged at a bottom of the first aluminum alloy surface eave.

8. The house having the aluminum alloy structure according to claim 1, wherein a dripping rim is arranged at another end of the first aluminum alloy surface eave.

9. The house having the aluminum alloy structure according to claim 1, wherein a dripping rim is arranged at another end of the second aluminum alloy surface eave.

* * * * *